US009410774B1

(12) United States Patent
Gallo

(10) Patent No.: US 9,410,774 B1
(45) Date of Patent: Aug. 9, 2016

(54) FLUTED ARROW SHAFT AND DETACHABLE ARROWHEAD

(71) Applicant: Ryan Matthew Gallo, Elsberry, MO (US)

(72) Inventor: Ryan Matthew Gallo, Elsberry, MO (US)

( * ) Notice: Subject to any disclaimer, the term of this patent is extended or adjusted under 35 U.S.C. 154(b) by 0 days.

(21) Appl. No.: 14/825,292

(22) Filed: Aug. 13, 2015

Related U.S. Application Data

(60) Provisional application No. 62/036,815, filed on Aug. 13, 2014.

(51) Int. Cl.
*F42B 6/04* (2006.01)
*F42B 6/08* (2006.01)
*F42B 12/36* (2006.01)

(52) U.S. Cl.
CPC ... *F42B 6/04* (2013.01); *F42B 6/08* (2013.01); *F42B 12/362* (2013.01)

(58) Field of Classification Search
CPC ..... F42B 6/04; F42B 12/362
See application file for complete search history.

(56) References Cited

U.S. PATENT DOCUMENTS

| | | | | |
|---|---|---|---|---|
| 2,467,838 | A * | 4/1949 | Lust | F42B 6/04 473/581 |
| 5,273,293 | A | 12/1993 | Lekavich | |
| 6,129,642 | A | 10/2000 | DonTigny | |
| 6,595,880 | B2 | 7/2003 | Becker | |
| 6,932,728 | B2 * | 8/2005 | Palomaki | F42B 6/08 473/578 |
| 2006/0281593 | A1 | 12/2006 | Young | |
| 2008/0207362 | A1 * | 8/2008 | Kuhn | F42B 10/24 473/586 |

* cited by examiner

*Primary Examiner* — John Ricci
(74) *Attorney, Agent, or Firm* — Williams Intellectual Property; Benjamin F. Williams

(57) ABSTRACT

A fluted arrow shaft and detachable arrowhead that includes an arrow shaft having a plurality of recessed grooves disposed evenly spaced apart longitudinally thereupon, between a fletching disposed at a distal end of the shaft, and an inset disposed proximal an arrowhead, this inset disposed underlying a rearmost extension of each of a plurality of blades comprising said arrowhead, wherein each inset is disposed for position in a wound inflicted by the arrowhead to effect increased blood loss drained along each of the plurality of recessed grooves, whereby debility and fatility of prey is more expediently effective.

6 Claims, 2 Drawing Sheets

FLUTED ARROW SHAFT AND DETACHABLE ARROWHEAD

CROSS-REFERENCE TO RELATED APPLICATIONS

This nonprovisional application for patent claims the benefit of provisional application No. 62/036,815 filed on Aug. 13, 2014.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of arrows are known in the prior art. Most comprise a cylindrical shaft connected to an arrowhead for striking a target or prey. However, such arrows can inadvertently staunch the very wound they are meant to inflict, slowing potential blood loss and increasing time to death. This increases suffering in the prey and, also, is makes collecting the prey more difficult as it may continue away from the archer over a prolonged time.

What is needed is a fluted arrow shaft and detachable arrowhead that includes an arrow shaft having a plurality of recessed grooves disposed evenly spaced apart longitudinally thereupon, between a fletching disposed at a distal end of the shaft, and an inset disposed proximal an arrowhead, said inset disposed underlying a rearmost extension of each of a plurality of blades comprising said arrowhead, wherein each inset is disposed for position in a wound inflicted by said arrowhead to effect increased blood loss drained along each of the plurality of recessed grooves, whereby debility and fatility of prey is more expediently effected.

FIELD OF THE INVENTION

The present invention relates to a fluted arrow shaft and detachable arrowhead, and more particularly, to a fluted arrow shaft and detachable arrowhead that includes an arrow shaft having a plurality of recessed grooves disposed evenly spaced apart longitudinally thereupon, between a fletching disposed at a distal end of the shaft, and an inset disposed proximal an arrowhead, said inset disposed underlying a rearmost extension of each of a plurality of blades comprising said arrowhead, wherein each inset is disposed for position in a wound inflicted by said arrowhead to effect increased blood loss drained along each of the plurality of recessed grooves, whereby debility and fatility of prey is more expediently effected.

SUMMARY OF THE INVENTION

The general purpose of the fluted arrow shaft and detachable arrowhead, described subsequently in greater detail, is to provide a fluted arrow shaft and detachable arrowhead which has many novel features that result in a fluted arrow shaft and detachable arrowhead which is not anticipated, rendered obvious, suggested, or even implied by prior art, either alone or in combination thereof.

The present fluted arrow shaft and detachable arrowhead has been devised to expedite fatality from a wound inflicted by an arrow. Arrows presently seen in the art comprise a cylindrical shaft disposed endwise from an arrowhead. The shaft is usable to accelerate the arrow as a projectile and for controlling directable flight of said projectile. However, once pierced by an arrowhead, a wound can become inadvertently staunched by the cylindrical shaft whereby rate of blood loss is lessened and fatality of the wound thereby delayed. Prey can thus continue on, making collection of said prey more difficult and time consuming, and the prey's suffering prolonged.

What is needed is a fluted arrow shaft and detachable arrowhead whereby blood loss is facilitated along each of a plurality of recessed grooves disposed longitudinally along an arrow shaft to effect increased drainage of blood from a wound inflicted by an arrow, whereby debilitation of prey is expedited and kill and capture thereby more effectively enabled.

The present fluted arrow shaft and detachable arrowhead, therefore, includes an arrow shaft disposed between a proximal end and a distal end. A plurality of recessed grooves is disposed evenly spaced apart longitudinally along said arrow shaft, between said proximal end and said distal end.

An arrowhead is attachable at the proximal end, said arrowhead threadably engageable with a threaded collar portion disposed in the proximal end. Each of the plurality of recessed grooves is disposed to initiate at an inset disposed proximal the proximal end. Each inset is disposed proximal the proximal end underlying a furthermost extension of each of a plurality of blades comprising said arrowhead, whereby each of said plurality of blades positions each inset disposed on the arrow shaft interior to a wound inflicted by said fluted arrow shaft and detachable arrowhead to facilitate blood loss drained therethrough.

Each of the plurality of recessed grooves is deepest at each associated inset, whereby blood flow into the inset, and thence along each of the plurality of recessed grooves, is effected when the arrowhead pierces targeted prey. Each of the plurality of recessed grooves may be disposed along a gradient, deepening toward the inset, from a shallowest portion disposed at the shaft distal end, to a deepest portion, disposed at the inset.

An elongate threaded member is disposed upon the arrowhead for securement into the threaded collar at the shaft proximal end. Importantly, this threaded member is disposed to project into the shaft when screwed therein and underlie each inset projected into the shaft in parallel with a portion of each of the plurality of recessed grooves, whereby a relative decrease in diameter of the shaft effected at each inset does not decrease tensile strength of the arrow, said elongate threaded member disposed inserted into the arrow therein.

Once the arrowhead pierces a prey, blood therefore is drainable along each of the plurality of recessed grooves to facilitate blood loss from the quarry and thus expedite debility of the prey, and fatality resultant from the wound, whereby kill and capture of the prey is more expediently effective.

Thus has been broadly outlined the more important features of the present fluted arrow shaft and detachable arrowhead so that the detailed description thereof that follows may be better understood and in order that the present contribution to the art may be better appreciated.

Objects of the present fluted arrow shaft and detachable arrowhead, along with various novel features that characterize the invention are particularly pointed out in the claims forming a part of this disclosure. For better understanding of the fluted arrow shaft and detachable arrowhead, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
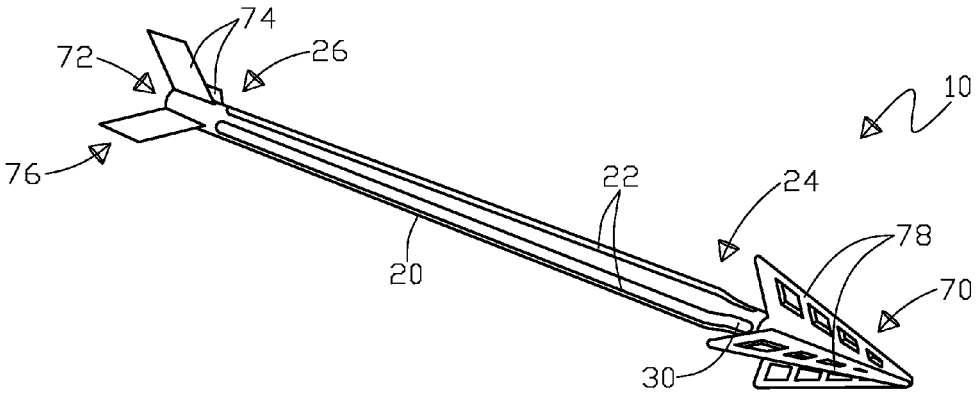
FIG. 1 is an isometric view of an example embodiment.
Figure 2:
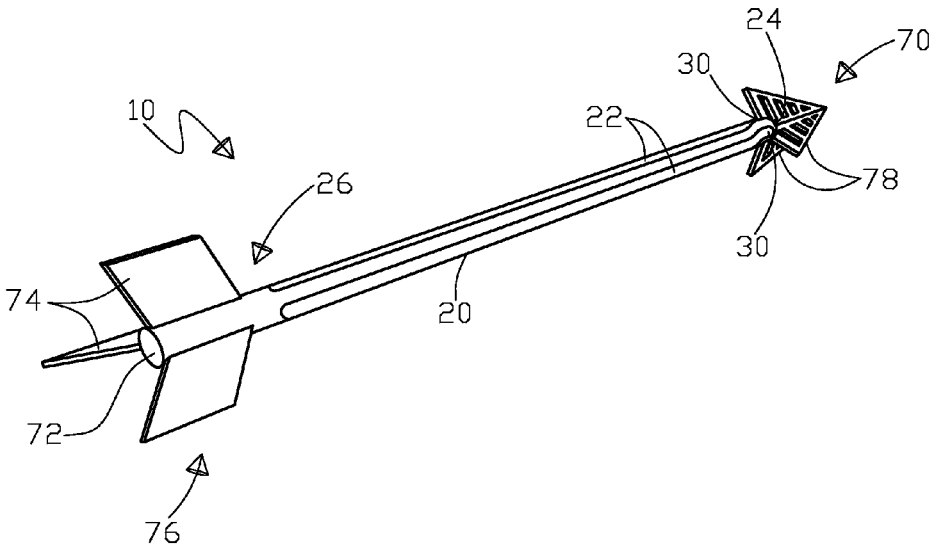
FIG. 2 is an isometric view of an example embodiment.
Figure 3:
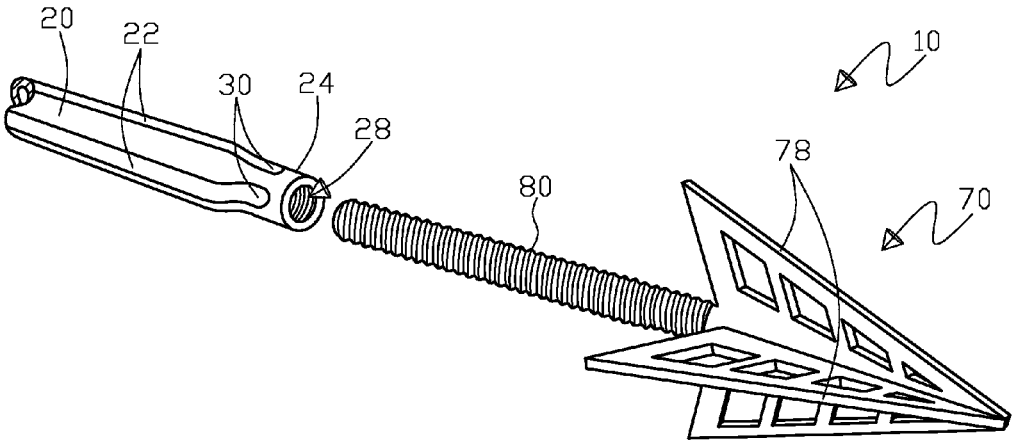
FIG. 3 is a detail view of an example embodiment having an arrowhead attachable at a threaded collar portion disposed in a proximal end of a fluted arrow shaft.
Figure 4:
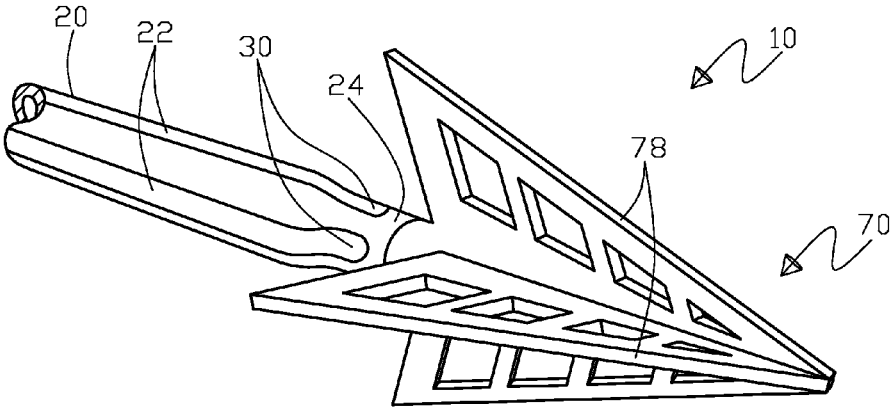
FIG. 4 is a detail view of an example embodiment having an arrowhead attached at the threaded collar portion disposed in the proximal end of the fluted arrow shaft.

With reference now to the drawings, and in particular FIGS. 1 through 4 thereof, example of the instant fluted arrow shaft and detachable arrowhead employing the principles and concepts of the present fluted arrow shaft and detachable arrowhead and generally designated by the reference number 10 will be described.

Referring to FIGS. 1 through 4 a preferred embodiment of the fluted arrow shaft and detachable arrowhead 10 is illustrated.

Use of arrows to fell prey is well known in the art. Most arrows seen in the art comprise a cylindrical shaft connected endwise with an arrowhead. The arrowhead pierces prey, to inflict a targeted and potentially fatal wound. However, the shaft itself may staunch the wound, impeding flow of blood therefrom, whereby fatality resulting from the arrow's impact can be delayed.

The present fluted arrow shaft and detachable arrowhead 10 has been devised to prevent inadvertent staunching of a wound inflicted by an arrow and facilitate free flow of blood from such a wound, whereby blood is drained from prey more rapidly, and kill and capture of said prey is expedited.

The present fluted arrow shaft and detachable arrowhead 10, therefore, includes an arrow shaft 20 having a plurality of recessed grooves 22 disposed longitudinally thereon, each of said plurality of recessed grooves 22 disposed evenly spaced apart between a proximal end 24 of the shaft 20, connected with an arrowhead 70, and a distal end 26 of the shaft 20, wherein a nook 72 is adorned with a plurality of vanes 74 comprising a fletching 76.

Each of the plurality of recessed grooves 22 enables passage of blood from a wound inflicted by the arrowhead 70, wherein flow of blood along each of the plurality of recessed grooves 22 facilitates bleeding and thus debilitation of the prey whereby capture and kill is expedited.

The arrowhead 70 is attachable at the proximal end 24, there fittable into a threaded collar portion 28 disposed endwise in the shaft 20 proximal end 24. Each of the plurality of recessed grooves 22 is initiated at an inset 30 proximal the threaded collar 28, a minimum distance from the proximal end 24 of the shaft 20 whereat each of a plurality of blades 78 of the arrowhead 70 extends over the inset 30 of each of the plurality of recessed grooves 22, whereby cleavage of flesh effective by each of said plurality of blades 78 engenders flow of blood from the wound into each inset 30 for drainage along each of the plurality of recessed grooves 22 and thus out of the prey.

Each of the plurality of recessed grooves 22 has a maximum depth at each associated inset 30. Tensile strength of the shaft 20 is not weakened, however, by this reduction in diameter of the shaft 20 at each inset 30, as an elongate threaded member 80 of the arrowhead 70, connectable and securable into the threaded collar 28, projects into the arrow shaft 20 and projects underlying each inset 30 into the arrow shaft 20, to thereby secure the arrowhead 70 to the shaft 20 and maintain integrity of the shaft 20 throughout the proximal end 24.

Each of the plurality of recessed grooves 22 may be disposed along a gradient from a shallowest depth most proximal the arrow shaft 20 distal end 26, and a deepest depth at the inset 30.

The fluted arrow shaft and detachable arrowhead 10, therefore, is enabled to effect increased bleeding from a wound inflicted by an arrow, whereby blood loss from said wound is facilitated and the respective prey is brought down more rapidly for expedited kill and capture, as desired.

What is claimed is:

1. A fluted arrow shaft and detachable arrowhead comprising:

a plurality of recessed grooves disposed longitudinally in an arrow shaft between a proximal end and a distal end of said arrow shaft;

an inset disposed in each recessed groove at the proximal end;

a threaded collar portion disposed at the proximal end;

an arrowhead having an elongate threaded member disposed distally thereupon, said arrowhead thereby threadably securable into the threaded collar portion; and a plurality of blades disposed upon the arrowhead angularly disposed and overhanging each inset;

wherein the arrow prevents inadvertent staunching of a wound inflicted by said arrow and facilitates bleeding from said wound by passage of blood drainable along each of the plurality of recessed grooves.

2. The fluted arrow shaft and detachable arrowhead of claim 1 wherein each of the plurality of recessed grooves is deepest at each inset.

3. The fluted arrow shaft and detachable arrowhead of claim 2 wherein the elongate threaded member of the arrowhead secures into the threaded collar portion to a depth penetrated into the arrow shaft passed each inset.

4. The fluted arrow shaft and detachable arrowhead of claim 3 wherein each of the plurality of recessed grooves is shallowest most proximal the distal end.

5. The fluted arrow shaft and detachable arrowhead of claim 4 wherein the plurality of blades consists of three blades, each of said three blades disposed to overhang an inset when the arrowhead is threadably secured at the threaded collar portion.

6. A fluted arrow shaft and detachable arrowhead comprising:

a plurality of recessed grooves disposed along a gradient longitudinally along an arrow shaft between a proximal end and a distal end of said arrow shaft;

an inset disposed in each recessed groove at the proximal end, each recessed groove disposed deepest at each said inset;

a threaded collar portion disposed at the proximal end;

an arrowhead having an elongate threaded member disposed distally thereupon, said arrowhead thereby threadably securable into the threaded collar portion to a depth penetrated into the arrow shaft underlying each inset; and a plurality of blades disposed upon the arrowhead angularly disposed and overhanging each inset;

wherein the arrow prevents inadvertent staunching of a wound inflicted by said arrow and facilitates bleeding from said wound by passage of blood drainable along each of the plurality of recessed grooves.

* * * * *